US005921753A

United States Patent [19]

Ames

[11] Patent Number: 5,921,753

[45] Date of Patent: Jul. 13, 1999

[54] ANTI-WINDMILLING DEVICE

[76] Inventor: Gary A. Ames, 4986 Highway 44 E., Shepherdsville, Ky. 40165

[21] Appl. No.: 09/038,608

[22] Filed: Mar. 11, 1998

[51] Int. Cl.[6] ..... A47C 7/74; B63H 1/00

[52] U.S. Cl. ..... 416/169 R

[58] Field of Search ..... 416/169 R, 140, 416/153, 46

[56] References Cited

U.S. PATENT DOCUMENTS 3,575,527 4/1971 Watanabe et al. ..... 416/169 R X
4,642,029 2/1987 Cedoz .
4,664,596 5/1987 Wood ..... 416/169 R X
5,428,965 7/1995 Grunwald et al. .
5,497,632 3/1996 Robinson .
5,562,418 10/1996 Agius ..... 416/169 R

*Primary Examiner*—John E. Ryznic
*Attorney, Agent, or Firm*—Henderson & Sturm

[57] ABSTRACT

An anti windmilling device 10 for fan blades 103 including a housing member 20 adapted to be secured to the wire grid 101 of a fan 104. The housing member 20 rotatably supports a sail member 40 mounted on a shaft element 42 dimensioned to engage a portion 28 of the housing member 20. The sail member 40 is normally spring biased into the arc of rotation of the fan blades 103 for preventing the unwanted rotation of the blades 103 when the fan 104 is not energized.

9 Claims, 1 Drawing Sheet

ANTI-WINDMILLING DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of fan braking mechanisms in general, and in particular to an anti-windmilling device for fan blades.

2. Description of Related Art

As can be seen by reference to the following U.S. Pat. Nos. 4,642,029; 5,428,965; 5,497,632; and 5,562,418, the prior art is replete with myriad and diverse fan motor control and braking systems.

While all of the aforementioned prior art constructions are more than adequate for the basic purpose and function for which they have been specifically designed, they are uniformly deficient with respect to their failure to provide a simple, efficient, and practical device for preventing damage to the sleeve bearings of a condenser fan motor of a refrigeration unit due to the unwanted rotation of the fan blades when the fan motor is not in operation which leads to both metal fatigue and loss of lubrication in the motor sleeve bearing.

As a consequence of the foregoing situation, there has existed a longstanding need for a new and improved anti-windmill accessory device that can be installed on existing housings containing a condenser fan, and the provision of such a construction is a stated objective of the present invention.

BRIEF SUMMARY OF THE INVENTION

Briefly stated, the anti-windmilling device that forms the basis of the invention comprises in general, a housing unit and a sail unit rotatably disposed relative to the housing unit which is operatively connected to a portion of the fan housing wherein a portion of the flag unit extends into the arc of rotation of the fan blades.

As will be explained in greater detail further on in the specification, the housing unit comprises a housing member adapted to be connected to the wire grid that is positioned in front of the fan blades for safety purposes.

In addition, the sail unit includes a sail member mounted on a shaft element that is rotatably disposed within the housing member and dimensioned to engage a portion of the housing member to limit the movement of the shaft element in one direction.

Furthermore, a spring element is operatively associated with both the housing member and the sail member to normally bias the sail member into the arc of rotation of the fan blades such that when the fan is energized air flow will deflect the sail member away from the arc of rotation of the fan blades and when the fan is shut off, the sail member will prevent the rotation of the fan blades in one direction and resist the rotation of the fan blades in the other direction.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 3:
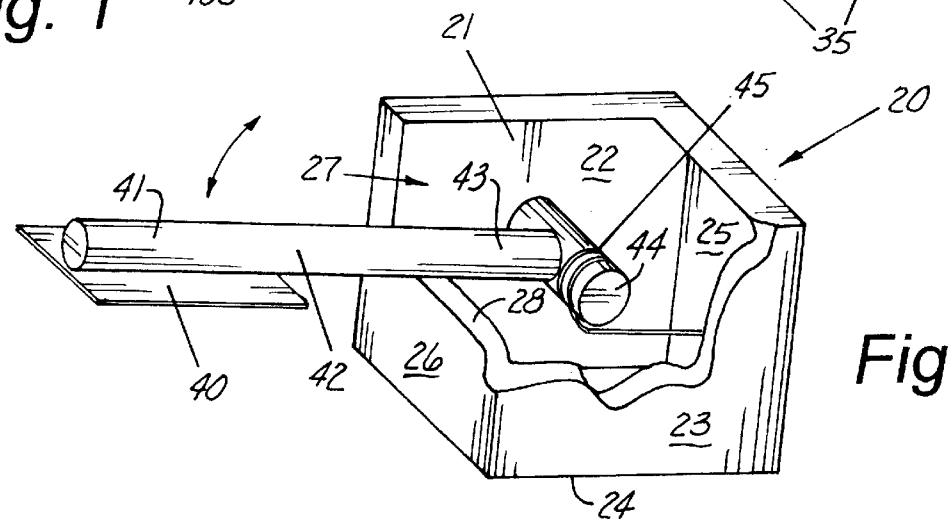
FIG. 3 is a cut away view of the sail unit and the interior of the housing unit.

As can be seen by reference to the drawings, and in particularly to FIG. 3, the anti windmill device that forms the basis of the present invention is designated generally by the reference number 10. The device 10 comprises in general, a housing unit 11, and a sail unit 12. These units will now be described in seriatim fashion.

Figure 1:
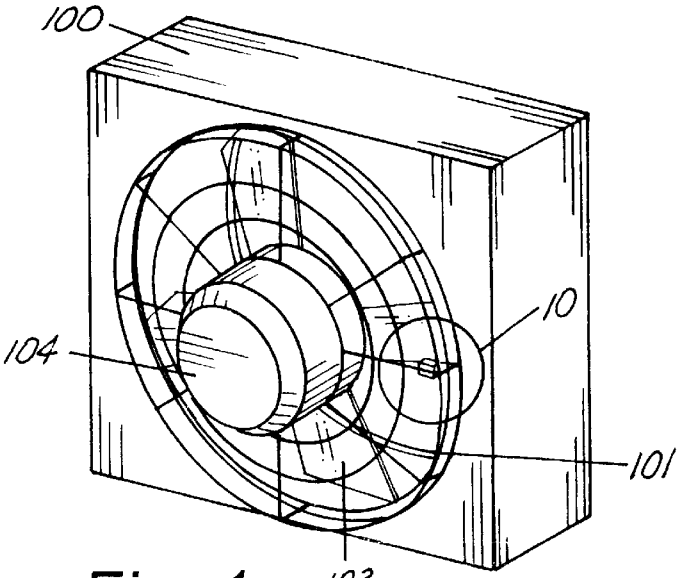
FIG. 1 is a perspective view of the anti-windmilling device that forms the basis of this invention mounted on a condenser fan housing.

Prior to embarking on a detailed description of the device 10, it would first be advisable to briefly describe the environment in which the device is intended to be deployed. As shown in FIG. 1, the device 10 is installed on the wire grid 101 on the front of a condenser fan housing 100. The wire grid 101 is spaced outwardly from the blades 103 of a condenser fan 104 in a well recognized fashion.

Figure 2:
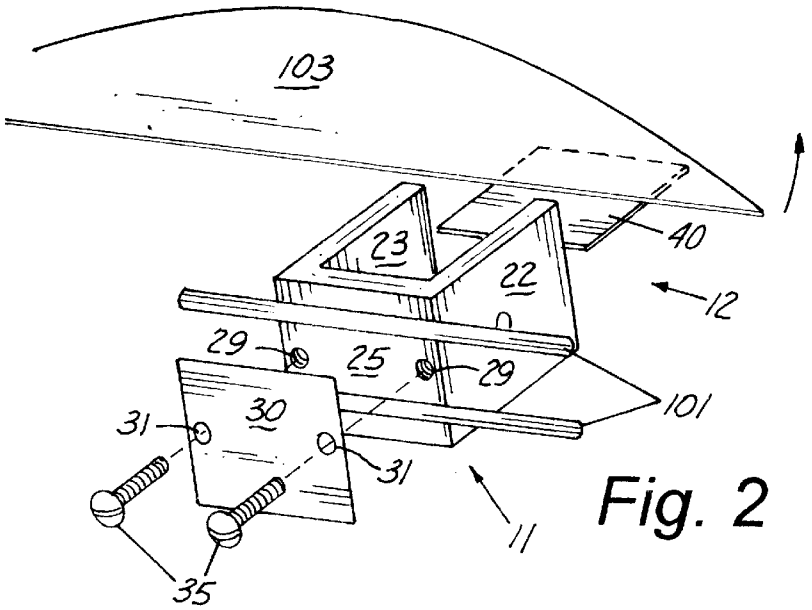
FIG. 2 is an isolated detail view showing the housing unit attachment to the fan grill.

Turning now to FIGS. 2 and 3, it can be seen that the housing unit 11 comprises a generally rectangular housing member 20 having an open top 21, a pair of sidewalls 22, 23, a bottom wall 24, a rear wall 25, and a front wall 26.

In addition, the front wall 26 is provided with an enlarged opening 27 which defines a stop ledge 28 and the rear wall 25 is provided with a pair of apertures 29 whose purpose and function will be described presently.

As can best be seen by reference to FIG. 2, the housing unit 11 further includes a mounting plate member 30 provided with a pair of apertures 31 which are aligned with the apertures 29 in the rear wall 25 of the housing member 20 for attaching the housing member 20 to the fan grid 101 via fastening elements 35 in a well recognized fashion.

As shown in FIGS. 2 and 3, the sail unit 12 comprises a lightweight sail member 40 mounted on one end 41 of an elongated shaft 42 wherein the other end 43 of the shaft is attached to an axle element 44 which is rotatably mounted in one of the sidewalls 22, 23 of the housing member 20. In addition, the axle element 44 is further provided with a relatively weak spring element 45 for normally biasing the shaft 42 into contact with the stop ledge 28 on the front wall 26 of the housing.

As can best be seen by reference to FIG. 2, the sail member 40 is dimensioned to extend into the path of travel of the fan blades 103. However, when the fan 104 is energized, the force of the air in front of the fan blades 103 will be sufficient to overcome the spring biasing produced by the spring element 45 such that the sail member 40 will be pivoted out of contact with the fan blades 103.

On the other hand, when the fan 104 is shut off, the sail member 40 will once again move into the arc of rotation of the fan blades 103 eliminating the counterrotation of the blades 103 and resisting movement of the blades 103 in the normal direction of rotation through the biasing action of the spring 45 on the sail member 40.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. An anti windmilling device for the selective engagement with the blades of a fan mounted in a fan housing provided with a fan grid; wherein the device comprises:

a housing unit including a housing member having an open top, a front wall provided with an enlarged opening defining a stop ledge and at least one sidewall;

a sail unit including a spring biased sail member rotatably disposed relative to the housing member; and means for mounting the housing unit on the fan grid wherein the said member is positioned in line with the arc of rotation of the fan blades.

2. The device as in claim 1 wherein the sail unit further comprises an elongated shaft having one end attached to the flag member.

3. The device as in claim 2 wherein the sail unit further comprises an axle element rotatably disposed in the at least one sidewall in the housing member.

4. The device as in claim 3 wherein the other end of the shaft element is attached to the axle element.

5. The device as in claim 4 wherein the shaft element is dimensioned to engage and extend beyond the stop ledge on the front wall of the housing member to arrest the movement of the sail member in one direction.

6. The device as in claim 4 wherein the sail unit further includes a spring element operatively associated with the said member.

7. The device as in claim 6 wherein the spring element normally biases the sail member into the arc of rotation of the fan blades.

8. The device as in claim 1 wherein said means for mounting the housing unit on the fan grid comprises a mounting plate member adapted to captively engage the fan grid between the mounting plate member and the housing member.

9. The device as in claim 6 wherein the spring element is attached on one end to the axle element and attached on the other end to a portion of the housing member.

* * * * *